US007460139B2

(12) United States Patent
Song et al.

(10) Patent No.: US 7,460,139 B2
(45) Date of Patent: Dec. 2, 2008

(54) METHOD AND APPARATUS OF DRIVING A PLASMA DISPLAY PANEL

(75) Inventors: Byung Soo Song, Gyeonggi-do (KR); Chang Ho Hyeon, Yongin-si (KR); Hwan Yu Kim, Uiwang-si (KR); Geun Soo Lim, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/856,955

(22) Filed: Sep. 18, 2007

(65) Prior Publication Data

US 2008/0007487 A1 Jan. 10, 2008

Related U.S. Application Data

(62) Division of application No. 10/952,473, filed on Sep. 29, 2004.

(30) Foreign Application Priority Data

Sep. 30, 2003 (KR) ..... 10-2003-0067935
Dec. 10, 2003 (KR) ..... 10-2003-0089891
Dec. 10, 2003 (KR) ..... 10-2003-0089892

(51) Int. Cl.
*G09G 5/10* (2006.01)

(52) U.S. Cl. ..... 345/691; 345/60

(58) Field of Classification Search ..... 345/60–69, 345/690–693; 315/169.4
See application file for complete search history.

(56) References Cited

U.S. PATENT DOCUMENTS 4,720,744 A * 1/1988 Washi et al. ..... 348/469
5,531,224 A * 7/1996 Ellis et al. ..... 600/437
6,043,801 A * 3/2000 Bassetti ..... 345/89
6,636,187 B2 10/2003 Tajima et al. ..... 345/55
6,657,609 B2 * 12/2003 Starr ..... 345/94

(Continued)

FOREIGN PATENT DOCUMENTS

EP 0 650 293 10/1994

(Continued)

OTHER PUBLICATIONS

Chinese Office Action dated Sep. 21, 2007.

(Continued)

*Primary Examiner*—Richard Hjerpe
*Assistant Examiner*—Tom V Sheng
(74) *Attorney, Agent, or Firm*—Ked & Associates, LLP

(57) ABSTRACT

The present invention relates to a plasma display panel, and more particularly, to a method and apparatus for driving a plasma display panel. According to a first embodiment of the present invention, there is provided a method for driving a PDP including the steps of dividing two frame data items into three frame data items; and providing the divided frame data items to the PDP. According to a first embodiment of the present invention, there is provided a method for driving a PDP including the steps of dividing two frame data items into three frame data items; and providing the divided frame data items to the PDP. The method and apparatus for driving a PDP according to the present invention can reduce large area flicker and dynamic false contour noise in a high-resolution PDP.

14 Claims, 10 Drawing Sheets

U.S. PATENT DOCUMENTS

| | | | | |
|---|---|---|---|---|
| 6,831,634 | B1 | 12/2004 | Shigeta | 345/213 |
| 6,831,700 | B2 * | 12/2004 | Hoshikawa | 348/446 |
| 6,853,359 | B2 * | 2/2005 | Hashimoto | 345/63 |
| 6,909,441 | B2 * | 6/2005 | Hashimoto | 345/690 |
| 6,911,784 | B2 * | 6/2005 | Sasaki et al. | 315/169.4 |
| 6,985,126 | B2 | 1/2006 | Hoppenbrouwers et al. | |
| 2003/0206185 | A1 | 11/2003 | Thebault et al. | |
| 2004/0041760 | A1 * | 3/2004 | Tsumura et al. | 345/87 |

FOREIGN PATENT DOCUMENTS

| | | |
|---|---|---|
| EP | 1231589 | 8/2002 |
| JP | 05127612 | 5/1993 |
| JP | 10171401 | 6/1998 |
| JP | 10-304281 | 11/1998 |
| JP | 10304281 | 11/1998 |
| WO | WO 03/012770 | 2/2003 |

OTHER PUBLICATIONS

Korean Office Action dated Jun. 27, 2005.
Korean Office Action dated Dec. 22, 2005.
European Search Report Dated Feb. 8, 2006.
Franzen O et al.: "Intermediate image interpolation using polyphase weighted median filters" Proceedings of the SPIE, SPIE, Bellingham, VA, US, vol. 4304, Jan. 2001, pp. 306-317, XP002217523 ISSN: 0277-786X.
Blume H: "New Algorithm for Nonlinear Vector-Based Upconversion With Center Weighted Medians" Journal of Electronic Imaging, SPIE / IS & T, US, vol. 6, No. 3, Jul. 1, 1997, pp. 368-378, XP000704802 ISSN: 1017-9909.

* cited by examiner $$\text{Ins. Fr.} = \frac{\text{1st Fr.} + \text{2nd Fr.}}{2}$$

(1st Frame + 2nd Frame) /2

METHOD AND APPARATUS OF DRIVING A PLASMA DISPLAY PANEL

CROSS-REFERENCE TO RELATED APPLICATIONS

This application is a Divisional Application of prior U.S. patent application Ser. No. 10/952,473 filed Sep. 29, 2004, which claims priority under 35 U.S.C. §119 to Korean Application No. 10-2003-0067935 filed in Korea on Sep. 30, 2003, Application No. 10-2003-0089891 filed in Korea on Dec. 10, 2004 and Application No. 10-2003-0089892 filed in Korea on Dec. 10, 2004, the entire contents of which are hereby incorporated by reference.

BACKGROUND OF THE INVENTION

1. Field of the Invention

The present invention relates to a plasma display panel, and more particularly, to a method and apparatus for driving a plasma display panel.

2. Description of the Background Art

A Plasma display panel (hereinafter, referred to as "PDP") is adapted to display an image by light-emitting phosphors with ultraviolet rays generated during the discharge of an inert mixed gas such as He+Xe or He+Xe. This PDP can be easily made thin and large, and it can provide greatly enhanced picture quality with the recent development of the relevant technology. Particularly, a three-electrode AC surface discharge type PDP has advantages of lower driving voltage and longer product lifespan as a wall charge is accumulated on a surface in discharging and electrodes are protected from sputtering caused by discharging.

FIG. 1 is a perspective view illustrating the construction of a discharge cell of a conventional three-electrode AC surface discharge type PDP. Referring now to FIG. 1, the three-electrode AC surface discharge type PDP includes a plurality of scan electrodes Y and a plurality of sustain electrodes Z which are formed on the bottom surface of an upper substrate 10, and an address electrode X formed on a lower substrate 18. The discharge cell of the PDP is formed at every crossing of the scan electrodes Y, the sustain electrodes Z and the address electrodes X and is arranged in a matrix form.

Each of the scan electrode Y and the sustain electrode Z includes a transparent electrode 12, and a metal bus electrode 11 that has a line width smaller than the transparent electrode 12 and is disposed at one side of the transparent electrode. The transparent electrode 12, which is generally made of ITO (indium tin oxide), is formed on the bottom surface of the upper substrate 10. The metal bus electrode 11 is generally formed of a metal on the transparent electrode 12 and serves to reduce a voltage drop caused by the transparent electrode 12 having high resistance. On the bottom surface of the upper substrate 10 in which the scan electrodes Y and the sustain electrodes are disposed is laminated an upper dielectric layer 13 and a protective layer 14. The upper dielectric layer 13 is accumulated with a wall charge generated during plasma discharging. The protective layer 14 is adapted to prevent damages of the electrodes Y and Z and the upper dielectric layer 13 due to sputtering caused during plasma discharging, and improve efficiency of secondary electron emission. As the protective layer 14, magnesium oxide (MgO) is generally used.

The address electrodes X are formed on the lower substrate 18 in the direction that they intersect the scan electrodes Y and the sustain electrodes Z. A lower dielectric layer 17 and a diaphragm 15 are formed on the lower substrate 18. A phosphor layer 16 is formed on the surface of the lower dielectric layer 17 and the diaphragm 15. The phosphor layer 16 is excited with ultraviolet rays generated during the plasma discharging to generate any one visible light of red, green and blue lights. An inert mixed gas such as He+Xe, Ne+Xe or He+Xe+Ne for discharge is injected into the discharge space of the discharge cells provided between the upper and lower substrates 10 and 18 and the diaphragm 15.

Such a three-electrode AC surface discharge type PDP is driven in such a way that one frame is divided into several sub fields of different emission numbers based on an address-display-separated sub field driving system. FIG. 2 shows a conventional one frame containing eight time-divided sub fields. If an image is to be represented using 256 gray levels, a frame period (16.67 ms) corresponding to (1/60 second is divided into 8 sub fields SF1 to SF8, as shown in FIG. 2. Each of the sub fields SF1 to SF8 is divided into a reset period for initializing a discharge cell, an address period for selecting a discharge cell, and a sustain period for implementing the gray level according to the number of discharge. The reset period and the address period of each of the sub fields SF1 to SF8 are the same in every sub fields, whereas the sustain period and its discharge number increase in the ratio of $2^n$(n=0, 1, 2, 3, 4, 5, 6, 7) in each sub field.

The aforementioned PDP driving method causes picture quality to vary with the order, weight and number of the sub fields. When the PDD driving method is used, motion artifact, large area flicker and a variation in the number of visible gray levels affect the picture quality. The motion artifact is caused by dynamic false contour noise and motion blurring. The dynamic false contour noise appears as a subfield-driven non-linear emission pattern, and the motion blurring occurs when light is emitted from pixels for a period of time loner than one frame period. The dynamic false contour noise and the number of gray levels (the number of sub fields) or the large area flicker and the motion blurring have a complementary function relationship between them. For example, the motion blurring occurs when a frame frequency is increased in order to reduce flicker whereas sever flicker is generated when the frame frequency is decreased in order to reduce the motion blurring.

Recently, some PDP manufacturers have attempted to improve picture quality deterioration such as the dynamic false contour noise, large area flicker and so on by rearranging sub fields and modulating the frame frequency from 50 Hz to 100 Hz as shown in FIG. 3. In FIG. 3, the vertical axis represents a weight given to each sub field and the horizontal axis represents time. When the method shown in FIG. 3 is employed, large area flicker generated at 50 Hz can be reduced and an emission pattern can be dispersed with a 100 Hz driving method to decrease the dynamic false contour noise. However, the address period and the sustain period become short seriously as resolution is increased to WVGA, XGA or HD resolution so that it is impossible to arrange sub fields at 100 Hz.

Another method for reducing flicker is to make the optical center of the maximum brightness uniform in every frame when the optical center of the maximum brightness is varied with frames in a sub frame array in which weights are linearly arranged. However, this method requires a complicated algorithm and circuit for calculations for making the optical center uniform in every frame.

Furthermore, there is an attempt to remove the dynamic false contour noise using a method of increasing the number of sub fields while varying a panel luminance or a method of increasing the number of sub fields without varying the panel luminance in such a manner that the address period and vertical resolution are exchanged. In this case, however, there is a limitation in increasing the number of sub fields when the resolution of PDP is increased. Furthermore, a vertical data component may be lost due to bit line repeat of a pre-filter.

SUMMARY OF THE INVENTION

Accordingly, an object of the present invention is to solve at least the problems and disadvantages of the background art.

An object of the present invention is to provide a method and apparatus for driving a PDP with high resolution, which can reduce large area flicker and dynamic false contour noise.

According to a first embodiment of the present invention, there is provided a method for driving a PDP including the steps of dividing two frame data items into three frame data items; and providing the divided frame data items to the PDP.

An apparatus for driving a PDP according to the first embodiment of the present invention includes a frame converting unit for dividing two frame data items into three frame data items; and a data providing unit for providing the divided data items to the PDP.

According to second embodiment of the present invention, there is also provided a method for driving a PDP including the steps of: writing nth frame data (n is a natural number) in an odd-numbered line of a memory, writing (n+1)th frame data in an even-numbered line of the memory, generating a single insertion data item using data items read by addressing the odd-numbered line and even-numbered line of the memory, and inserting the insertion data between the nth frame data and the (n+1)th frame data; and providing the nth frame data, the (n+1)th frame data and the insertion data to the PDP.

An apparatus for driving a PDP according to the second embodiment of the present invention includes a memory including an odd-numbered line storing nth frame data (n is a natural number) and an even-numbered line storing (n+1)th frame data; a signal processor for generating a single insertion data item using data items read by addressing the odd-numbered line and even-numbered line of the memory and inserting the insertion data between the nth frame data and the (n+1)th frame data; and a data providing unit for providing the nth frame data, the (n+1)th frame data and the insertion data to the PDP.

According to a third embodiment of the present invention, there is provided a method for driving a PDP including the steps of: storing (N−1)th frame data in a frame memory; separating main object image data and background image data from each of the stored (N−1)th frame data and Nth frame data currently input; generating object image data of an insertion frame using the main object image data of the (N−1)th frame data and the main object image data of the Nth frame data; generating background image data of the insertion frame using the background image data of the (N−1)th frame data and the background image data of the Nth frame data; and synthesizing the main object image data and background image data of the insertion frame to generate the insertion frame.

The method and apparatus for driving a PDP according to the present invention can reduce large area flicker and dynamic false contour noise in a high-resolution PDP.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
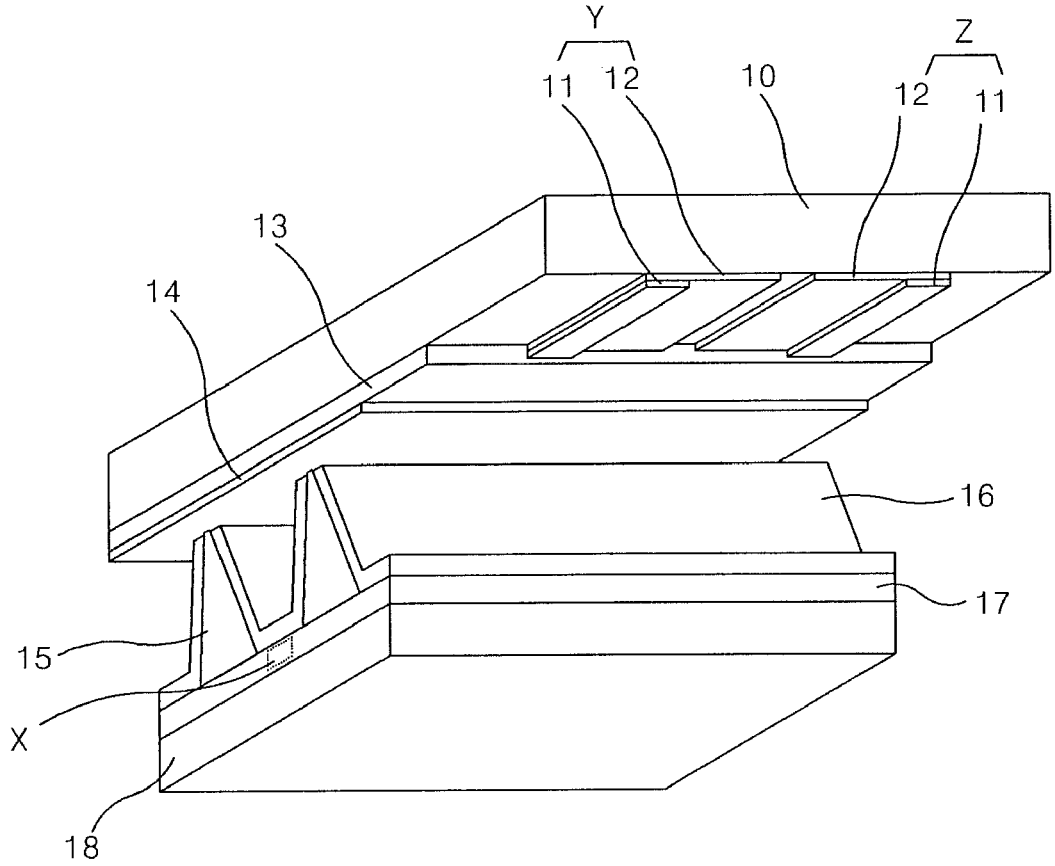
FIG. 1 is a perspective view illustrating the construction of a discharge cell of a conventional three-electrode AC surface discharge type PDP.
Figure 2:
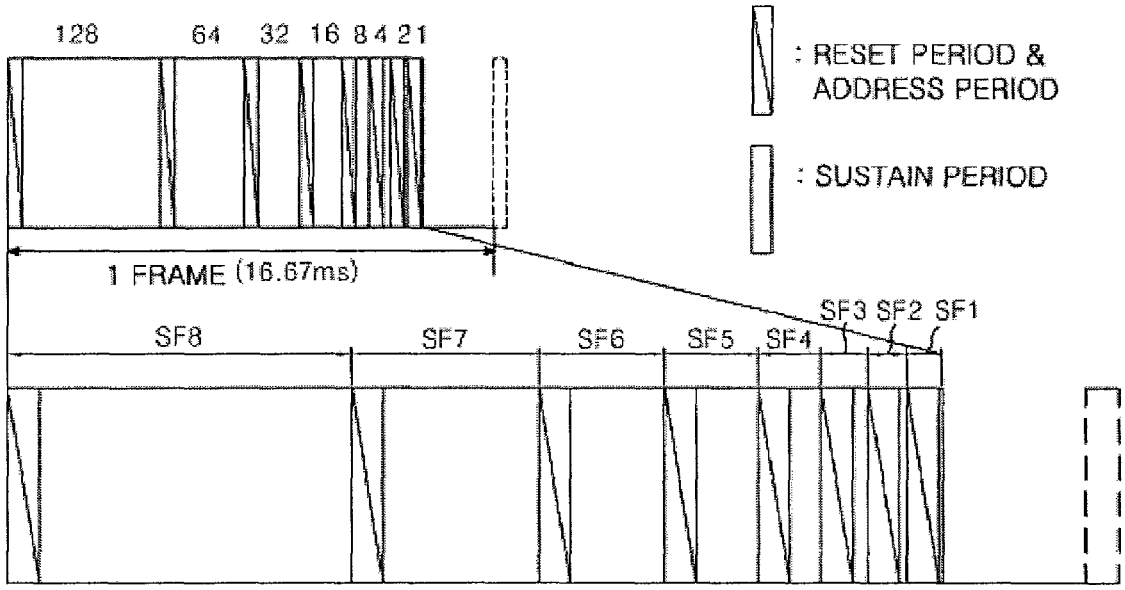
FIG. 2 shows a conventional one frame containing eight time-divided sub fields.
Figure 3:
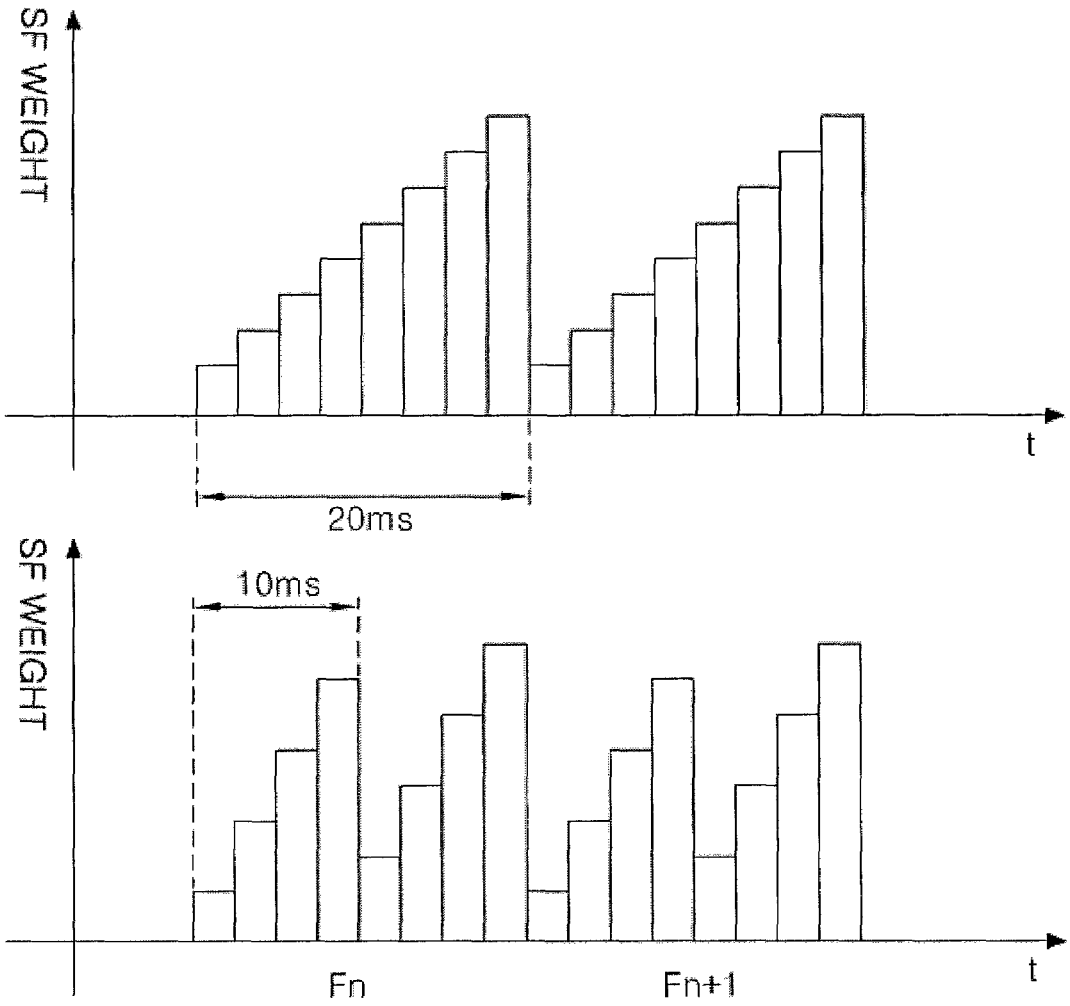
FIG. 3 shows a conventional 50 Hz driving method.

Preferred embodiments of the present invention will be described in a more detailed manner with reference to the drawings.

First and Second Embodiments

A method for driving a PDP according to a first embodiment of the present invention includes the steps of dividing two frame data items into three frame data items, and providing the divided frame data items to the PDP.

The two frame data items are input at a frame frequency of 50 Hz.

The step of dividing the two frame data items includes a step of calculating a mean value of the two frame data items and a step of inserting the mean value between the two frame data items.

The step of dividing the two frame data items includes a step of copying one of the two frame data items and a step of inserting the copied data between the two frame data items.

The two frame data items include nth frame data and (n+1)th frame data (n is a natural number larger than 1), and the method further includes a step of mapping the (n+1)th frame data, the nth frame data and data inserted between the nth and (n+1)th frame data to a sub field sequence including eight sub fields.

The two frame data items include nth frame data and (n+1)th frame data (n is a natural number larger than 1), and the method further includes a step of mapping the nth frame data to a sub field sequence including eight sub fields, a step of mapping data inserted between the nth frame data and the (n+1)th frame data to a sub field sequence including seven sub fields, and a step of mapping the (n+1)th frame data to a sub field sequence including nine sub fields.

The two frame data items include nth frame data and (n+1) th frame data (n is a natural number larger than 1), and the method further includes a step of mapping the nth frame data to a sub field sequence including nine sub fields, a step of mapping data inserted between the nth frame data and the (n+1)th frame data to a sub field sequence including six sub fields, and a step of mapping the (n+1)th frame data to a sub field sequence including nine sub fields.

A method for driving a PDP according to a modified one of the first embodiment of the present invention includes the steps of dividing five frame data items into six frame data items, and providing the divided frame data items to the PDP.

The five frame data items are input at a frame frequency of 50 Hz.

The step of dividing the five frame data items includes a step of calculating a mean value of two frame data items temporally adjacent to each other among the five frame data items, and a step of inserting the mean value between the two frame data items.

The step of dividing the five frame data items includes a step of copying one of two frame data items temporally adjacent to each other among the five frame data items, and a step of inserting the copied data between the two frame data items.

An apparatus for driving a PDP according to the first embodiment of the present invention includes a frame converting unit for dividing two frame data items into three frame data items, and a data providing unit for providing the divided data items to the PDP.

The two frame data items are input at a frame frequency of 50 Hz.

The frame converting unit calculates a mean value of the two frame data items and inserts the mean value between the two frame data items.

The frame converting unit copies one of the two frame data items and inserts the copied data between the two frame data items.

The frame converting unit includes a synchronous detector for detecting a frame frequency, a signal processor for inserting one of the mean value and the copied data between the two frame data items when the frame frequency is 50 Hz, and a controller for controlling the signal processor in response to the frame frequency.

An apparatus for driving a PDP according to the modified one of the first embodiment of the present invention includes a frame converting unit for dividing five frame data items into six frame data items, and a data providing unit for providing the divided data items to the PDP.

The five frame data items are input at a frame frequency of 50 Hz.

The frame converting unit calculates a mean value of two frame data items temporally adjacent to each other among the five frame data items and inserts the mean value between the two frame data items.

The frame converting unit copies one of two frame data items temporally adjacent to each other and inserts the copied data between the two frame data items.

The frame converting unit includes a synchronous detector for detecting a frame frequency, a signal processor for inserting one of the mean value and the copied data between the two frame data items when the frame frequency is 50 Hz, and a controller for controlling the signal processor in response to the frame frequency.

A method for driving a PDP according to a second embodiment of the present invention includes the steps of writing nth frame data (n is a natural number) in an odd-numbered line of a memory, writing (n+1)th frame data in an even-numbered line of the memory, generating a single insertion data item using data items read by addressing the odd-numbered line and even-numbered line of the memory, and inserting the insertion data between the nth frame data and the (n+1)th frame data; and providing the nth frame data, the (n+1)th frame data and the insertion data to the PDP.

The nth frame data and the (n+1)th frame data are input at a frame frequency of 50 Hz.

The insertion data is a copy of one of the odd-numbered line data and even-numbered line data of the memory.

The insertion data is inserted between two frame data items adjacent to each other among five frame data items input at the frame frequency of 50 Hz.

An apparatus for driving a PDP according to the second embodiment of the present invention includes a memory including an odd-numbered line storing nth frame data (n is a natural number) and an even-numbered line storing (n+1)th frame data; a signal processor for generating a single insertion data item using data items read by addressing the odd-numbered line and even-numbered line of the memory and inserting the insertion data between the nth frame data and the (n+1)th frame data; and a data providing unit for providing the nth frame data, the (n+1)th frame data and the insertion data to the PDP.

The nth frame data and the (n+1)th frame data are input at a frame frequency of 50 Hz.

The signal processor copies one of the odd-numbered line data and even-numbered line data of the memory to generate the insertion data.

The signal processor calculates a mean value of the odd-numbered line data and even-numbered line data of the memory to generate the insertion data.

The signal processor inserts the insertion data between two frame data items adjacent to each other among five frame data items input at the frame frequency of 50 Hz.

Hereafter, the first and second embodiments of the present invention will now be explained in more detail with reference to the attached drawings.

Figure 4:
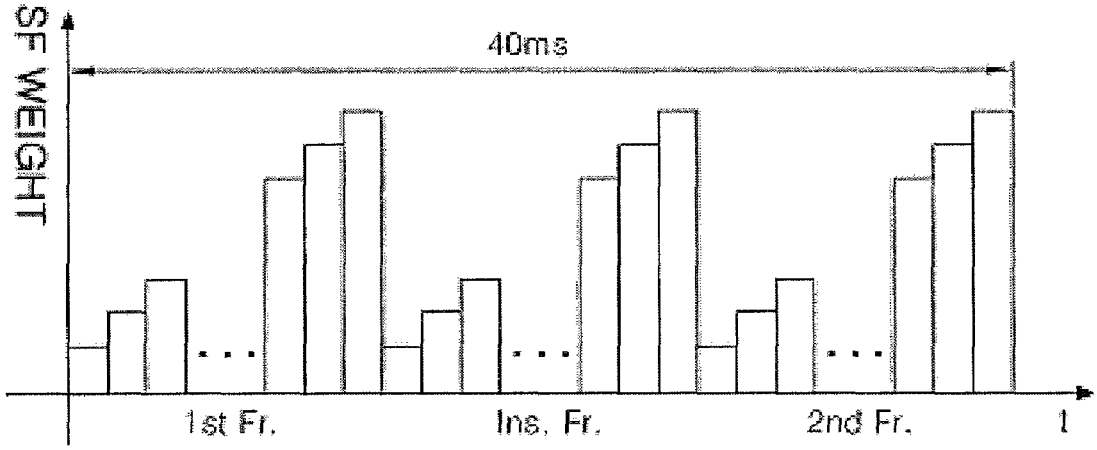
FIG. 4 is a diagram for explaining a method of driving a PDP according to a first embodiment of the present invention.
Figure 5:
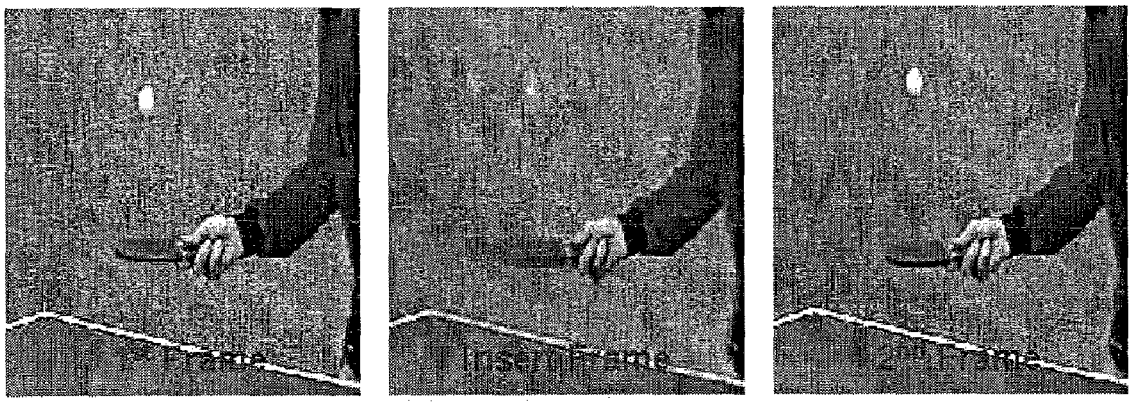
FIG. 5 shows input frame data items and an image of mean value data inserted between the data items when the PDP driving method according to the first embodiment of the present invention is applied to an experimental image.

Referring to FIGS. 4 and 5, the PDP driving method according to the first embodiment of the present invention inserts new frame data corresponding to a mean value of two frame data items, which are input during two frame periods corresponding to 40 ms, between the two frame data items when a frame frequency is 50 Hz to drive a PDP at pseudo 75 Hz.

When the two frame data items include the nth frame data Fn and the (n+1)th frame data Fn+1 (n is a natural number larger than 1), the frame data Fins inserted between the nth frame data and the (n+1)th frame data corresponds to the mean value of the temporally continuous two frame data items. That is, when the first frame data is 1st Fr. and the second frame data is 2nd Fr., the inserted frame data Fins is calculated by (1st Fr.+2nd Fr.)/2.

When the three frame data items including the frame data corresponding to the mean value are arranged for two frame periods when the PDP is driven at 50 Hz, light is dispersed and thus large area flicker and dynamic false contour noise can be reduced and the address period and sustain period of the high-resolution PDP can be secured.

Figure 6:
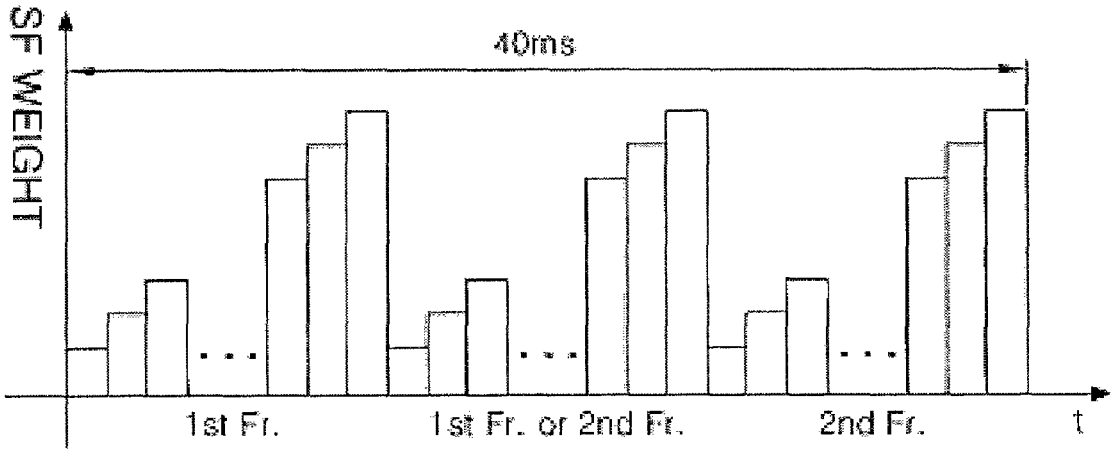
FIG. 6 is a diagram for explaining a method of driving a PDP according to a second embodiment of the present invention.
Figure 7:
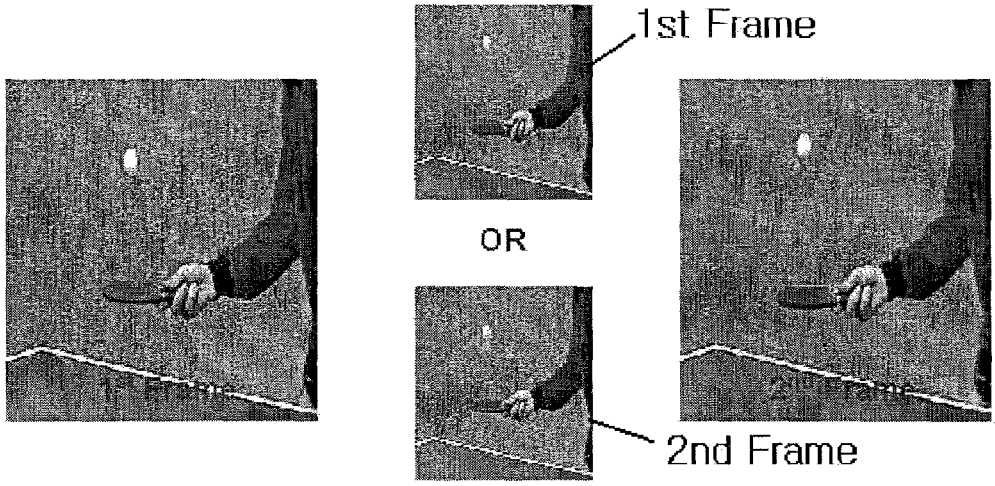
FIG. 7 shows input frame data items and an image of copy data inserted between the data items when the PDP driving method according to the second embodiment of the present invention is applied to an experimental image.

Referring to FIGS. 6 and 7, the PDP driving method according to the second embodiment of the present invention copies one of two frame data items that are input during two frame periods corresponding to 40 ms at a frame frequency of 50 Hz and inserts the copied data between the two frame data items to drive the PDP at pseudo 75 Hz.

When it is assumed that the two frame data items include the nth frame data Fn and the (n+1)th frame data Fn+1, the frame data inserted between the nth frame data and the (n+1) th frame data is identical to the nth frame data or the (n+1)th frame data. That is, during the two frame periods corresponding to 40 ms, the nth frame data, the (n+1)th frame data or the nth frame data, and the (n+1)th frame data are sequentially provided to the PDP.

When one frame data is inserted between the two frame data items at the frame frequency of 50 Hz to drive the PDP at the pseudo 75 Hz as described in the above-described embodiments, it is preferable that the number of sub fields of the continuous three frame data items is 8-8-8, 8-7-9 or 9-6-9 considering the large area flicker and dynamic false contour noise. The following tables 1, 2 and 3 represent examples of the number of sub fields and weights when the PDP is driven at the pseudo 75 Hz.

TABLE 1

| | SF1 | SF2 | SF3 | SF4 | SF5 | SF6 | SF7 | SF8 |
|---|---|---|---|---|---|---|---|---|
| Nth data | 1 | 2 | 4 | 8 | 16 | 46 | 46 | 47 |
| Insertion data | 1 | 2 | 4 | 8 | 16 | 46 | 46 | 47 |
| (n + 1)th data | 1 | 2 | 4 | 8 | 16 | 46 | 46 | 47 |

In Table 1, each of the nth frame data Fn, the insertion data Fins (Fn or Fn+1) and the (n+1)th frame data Fn+1 is mapped to eight sub fields to which weights 1, 2, 4, 8, 16, 46, 46 and 47 are respectively given.

TABLE 2

| | SF1 | SF2 | SF3 | SF4 | SF5 | SF6 | SF7 | SF8 | SF9 |
|---|---|---|---|---|---|---|---|---|---|
| Nth data | 1 | 2 | 4 | 8 | 16 | 46 | 46 | 47 | |
| Insertion data | 1 | 2 | 4 | 8 | 16 | 46 | 46 | | |
| (n + 1)th data | 1 | 2 | 4 | 8 | 16 | 46 | 46 | 47 | 47 |

In Table 2, the nth frame data Fn is mapped to eight sub fields to which weights 1, 2, 4, 8, 16, 46, 46, and 47 are given, and the insertion data Fins (Fn or Fn+1) is mapped to seven sub fields to which weights 1, 2, 4, 8, 16, 46 and 46 are given. The (n+1)th frame data Fn+1 are mapped to nine sub fields to which weights 1, 2, 4, 8, 16, 46, 46, 47 and 47 are given.

TABLE 3

| | SF1 | | | | | | | | |
|---|---|---|---|---|---|---|---|---|---|
| | SF1 | SF2 | SF3 | SF4 | SF5 | SF6 | SF7 | SF8 | SF9 |
| Nth data | 1 | 2 | 4 | 8 | 16 | 23 | 46 | 46 | 47 |
| Insertion data | | 2 | 4 | 8 | 16 | 46 | 46 | | |
| (n + 1)th data | 1 | 3 | 4 | 8 | 16 | 24 | 46 | 46 | 47 |

In Table 3, the nth frame data Fn is mapped to nine sub fields to which weights 1, 2, 4, 8, 16, 23, 46, 46, and 47 are given, and the insertion data Fins (Fn or Fn+1) is mapped to six sub fields to which weights 2, 4, 8, 16, 46 and 46 are given. The (n+1)th frame data Fn+1 are mapped to nine sub fields to which weights 1, 2, 4, 8, 16, 24, 46, 47 and 47 are given.

In Tables 1, 2 and 3, the weights can be varied with the composition of a discharge gas and a PDP model.

TABLE 4

| | SF1 | SF2 | SF3 | SF4 | SF5 | SF6 | SF7 | SF8 |
|---|---|---|---|---|---|---|---|---|
| Nth data | 1 | 4 | 8 | 16 | 24 | 25 | 30 | 30 |
| Insertion data | 1 | 4 | 8 | 16 | 24 | 25 | 30 | 30 |
| (n + 1)th data | 1 | 4 | 8 | 16 | 24 | 25 | 30 | 30 |

In Table 4, each of the nth frame data Fn, the insertion data Fins and the (n+1)th frame data Fn+1 is mapped to eight sub fields to which weights 1, 4, 8, 16, 24, 25, 30 and 30 are respectively given.

TABLE 5

| | SF1 | | | | | | | | |
|---|---|---|---|---|---|---|---|---|---|
| | SF1 | SF2 | SF3 | SF4 | SF5 | SF6 | SF7 | SF8 | SF9 |
| Nth data | 1 | 4 | 8 | 16 | 24 | 25 | 30 | 30 | |
| Insertion data | 1 | 4 | 8 | 16 | 24 | 25 | 30 | | |
| (n + 1)th data | 1 | 4 | 8 | 16 | 24 | 25 | 30 | 30 | 30 |

In Table 5, the nth frame data Fn is mapped to eight sub fields to which weights 1, 4, 8, 16, 24, 25, 30 and 30 are given, and the insertion data Fins (Fn or Fn+1) is mapped to seven sub fields to which weights 1, 4, 8, 16, 24, 25 and 30 are given. The (n+1)th frame data Fn+1 are mapped to nine sub fields to which weights 1, 4, 8, 16, 24, 25, 30, 30 and 30 are given.

TABLE 6

| | SF1 | SF2 | SF3 | SF4 | SF5 | SF6 | SF7 | SF8 | SF9 |
|---|---|---|---|---|---|---|---|---|---|
| Nth data | 1 | 4 | 8 | 16 | 24 | 25 | 30 | 30 | 30 |
| Insertion data | 1 | 4 | 8 | 16 | 24 | 25 | | | |
| (n + 1)th data | 1 | 4 | 8 | 16 | 24 | 25 | 30 | 30 | 30 |

In Table 6, the nth frame data Fn is mapped to nine sub fields to which weights 1, 4, 8, 16, 24, 25, 30, 30 and 30 are given, and the insertion data Fins (Fn or Fn+1) is mapped to six sub fields to which weights 1, 4, 8, 16, 24 and 25. The (n+1)th frame data Fn+1 are mapped to nine sub fields to which weights 1, 4, 8, 16, 24, 25, 30, 30 and 30 are given.

In Tables 1 to 6, the weights can be varied with the composition of a discharge gas or a PDP model.

A selective write/erase method can be applied to a cell selecting method and sub field arrangement. The selective write/erase method is more advantageous for high speed driving than a selective write method that selects an on-cell from a part of sub fields included in one frame and selects an off-cell from the other sub fields to thereby select only the on-cell and a selective erase method that selects only an off-cell from sub fields. Thus, the selective write-erase method is suitable for a PDP with high resolution and produces higher contrast and luminance. In the case where frame data is inserted between two frame data items at the frame frequency of 50 Hz to drive a PDP at the pseudo 75 Hz using the selective write/erase method, it is preferable that the number of sub fields of the continuous three frame data items is 8-8-8, 8-7-9 or 9-6-9 considering the large area flicker and dynamic false contour noise.

Figure 8:
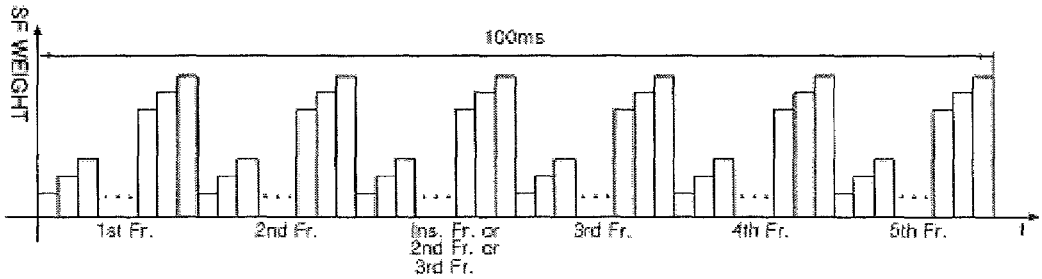
FIG. 8 is a diagram for explaining a method of driving a PDP according to another embodiment of the present invention.

Referring to FIG. 8, the PDP driving method according to the second embodiment of the present invention inserts data corresponding to a mean value of previous frame data and next frame data into a predetermined position during five frame periods corresponding to 100 ms at the frame frequency of 50 Hz or repeatedly provides one of the previous frame data and the next frame data to a PDP, to thereby drive the PDP at pseudo 60 Hz.

Assume nth, (n+1)th, (n+2)th, (n+3)th and (n+4)th frame data items which are temporally continuous. Data corresponding to a mean value of two frame data items continuously input during 100 ms or a copy of one of the two frame data items is inserted between the two frame data items. For instance, the inserted data can be a mean value of the second frame data 2nd Fr. and the third frame data 3rd Fr. or a copy of one of the second and third frame data items 2nd Fr. and 3rd Fr., and it is inserted between the second and third frame data items, as shown in FIG. 8.

When the data corresponding to the mean value of the continuous two frame data items or the copy of the one of the two frame data items is inserted into a predetermined position in the frame data sequence such that the PDP is driven at pseudo 60 Hz, light is dispersed and thus the large area flicker and dynamic false contour noise are reduced. Furthermore, the address period and sustain period of a PDP with high resolution is easily secured.

Figure 9:
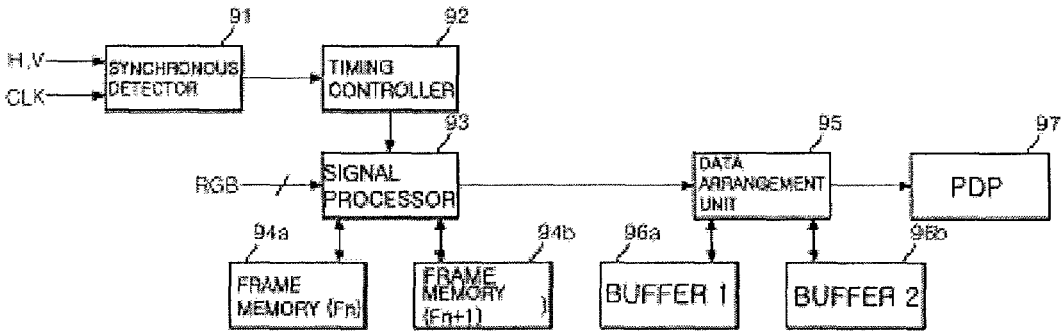
FIG. 9 is a block diagram of an apparatus for driving a PDP according to an embodiment of the present invention.

FIG. 9 is a block diagram of an apparatus for driving a PDP according to an embodiment of the present invention. The PDP driving apparatus includes a synchronous detector 91, a timing controller 92, a signal processor 93, frame memories 94*a* and 94*b*, a data arrangement unit 95, and buffers 96*a* and 96*b*.

The synchronous detector 91 counts a vertical synchronous signal V and a horizontal synchronous signal H in response to a clock signal CLK to detect a frame frequency and provides the frame frequency to the timing controller 92.

The signal processor 93 carries out error diffusion, gain control and dithering for digital video data RGB under the control of the timing controller 92, maps the digital video data to predetermined sub fields bit by bit, and then provides the mapped data to the data arrangement unit 95. When the frame frequency is 60 Hz, the signal processor 93 stores the digital video data RGB in the frame memories 94*a* and 94*b* frame by frame under the control of the timing controller 92, and then reads the data stored in the frame memories 94*a* and 94*b*. Then, the signal processor 93 carries out error diffusion, gain control and dithering for the read data and maps the data to twelve sub fields to which weights 1, 2, 4, 8, 16, 32, 32, 32, 32, 32, 32 and 32 are respectively given in a data input order. When the frame frequency is 50 Hz, the signal processor 93 stores digital video data RGB of the nth frame Fn in the first frame memory 94*a* and stores digital video data RGB of the (n+1)th frame in the second frame memory 94*b* under the control of the timing controller 92. Then, the signal processor inserts data corresponding to a mean value of the nth and (n+1)th frame data items or a copy of one of the nth and (n+1)th frame data items between the nth and (n+1)th frame data items or inserts the mean data or copy data into a predetermined position in five frame data items continuously input as described in the aforementioned embodiments.

The timing controller 92 controls the signal processor 93 in response to the frame frequency detected by the synchronous detector 91. Specifically, the timing controller 92 controls the signal processor 93 such that the signal processor 93 maps digital video data RGB to predetermined sub fields in the order of inputting the digital video data RGB when the frame frequency is 60 Hz. When the frame frequency is 50 Hz, the timing controller 92 controls the signal processor 93 such that the signal processor 93 inserts frame data between two continuous frame data items or insert frame data into a predetermined position in continuous five frame data items.

The data arrangement unit 95 temporarily stores data received from the signal processor 93 in the buffers 96*a* and 96*b*, and then provides data read from the buffers 96*a* and 96*b* to a data driving circuit chip of a PDP 97.

As described above, the method and apparatus for driving a PDP according to the first embodiment of the present invention can disperse light in a PDP with high resolution to reduce the large area flicker and dynamic false contour noise.

Furthermore, the method and apparatus for driving a PDP according to the second embodiments of the present invention write the nth frame data in odd-numbered lines of a memory and write the (n+1)th frame data in even-numbered lines of the memory, read odd-numbered line data of the memory and even-numbered line data that is the closest to the odd-numbered line data, and calculate a mean value of the read data items. Accordingly, a speed of calculating the mean value of the frame data items for reducing the large area flicker and dynamic false contour noise is reduced and thus the calculation can be efficiently carried out.

Third Embodiment

A method for driving a PDP according to the third embodiment of the present invention includes the steps of storing (N−1)th frame data in a frame memory; separating main object image data and background image data from each of the stored (N−1)th frame data and Nth frame data currently input; generating object image data of an insertion frame using the main object image data of the (N−1)th frame data and the main object image data of the Nth frame data; generating background image data of the insertion frame using the background image data of the (N−1)th frame data and the background image data of the Nth frame data; and synthesizing the main object image data and background image data of the insertion frame to generate the insertion frame.

The driving method further includes a step of displaying the (N−1)th frame, a step of displaying the insertion frame, and a step of displaying the Nth frame.

The number N is selected from 1 through 50.

The frames are driven at a frequency of 75 Hz.

Hereafter, the third embodiment of the present invention will now be explained in more detail with reference to the attached drawings.

Figure 10:
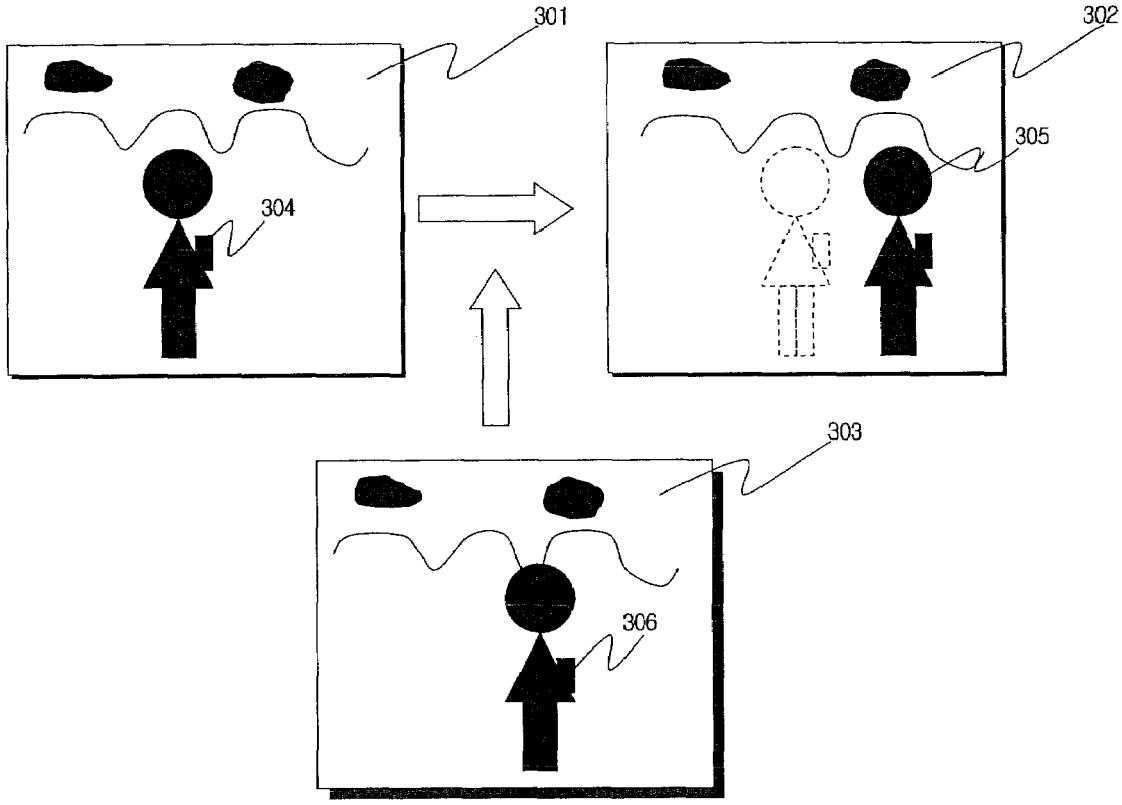
FIG. 10 shows a process of generating an insertion frame after an object is detected according to a third embodiment of the present invention.

FIG. 10 shows a process of generating an insertion frame after objects are detected according to the third embodiment of the present invention. The insertion frame is generated by image reconstruction.

Referring to FIG. 10, only main objects 304 and 305 are extracted from (N−1)th and Nth frames 301 and 302. A main object image of the insertion frame is reconstructed using the extracted main object images.

Then, a background image of the insertion frame is generated using background images of the (N−1)th and Nth frames 301 and 302.

The insertion frame 303 is generated using the generated object image and background image of the insertion frame. That is, the third embodiment of the present invention generates a new image by combining the extracted data in order to make the insertion frame for up-converting 50 Hz to 75 Hz, distinguished from a prior art that simply combines two data items to insert a blurred image. When the newly generated frame is inserted, a smooth motion can be represented and picture quality can be improved.

Figure 11:
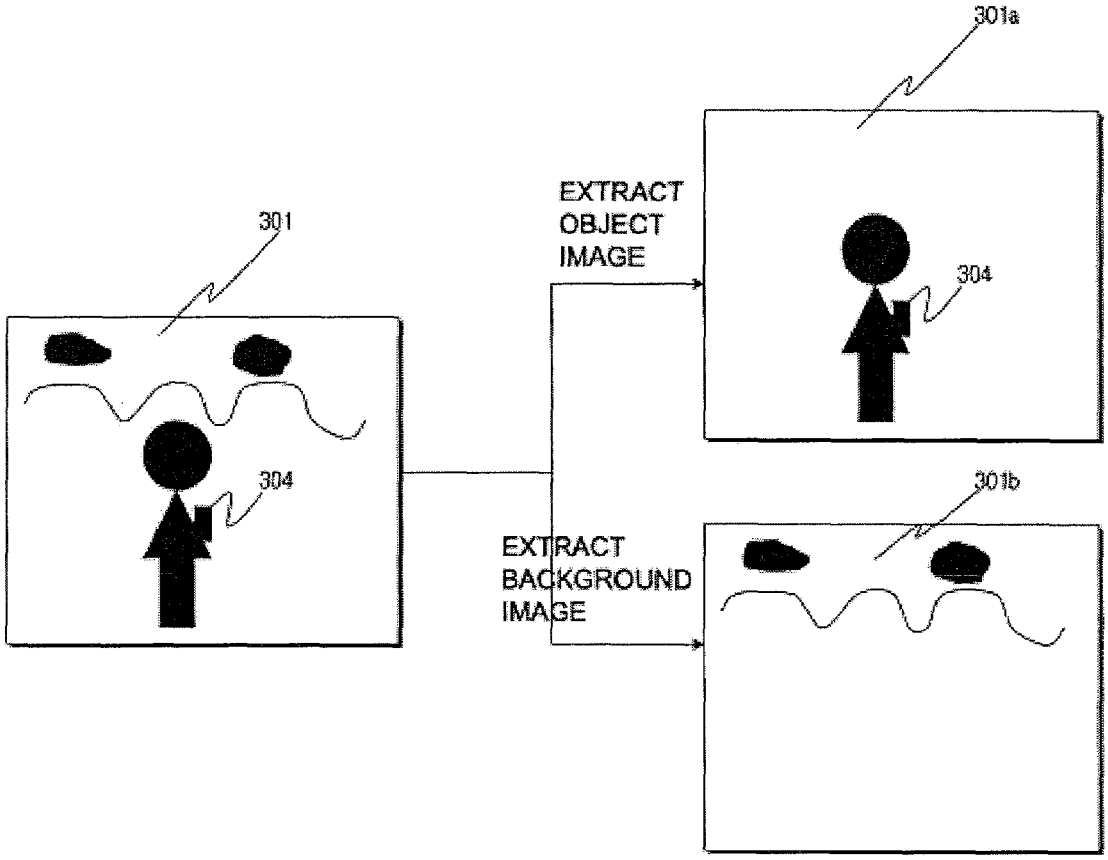
FIG. 11 shows a process of dividing frame data into a main object and a background image.
Figure 12:
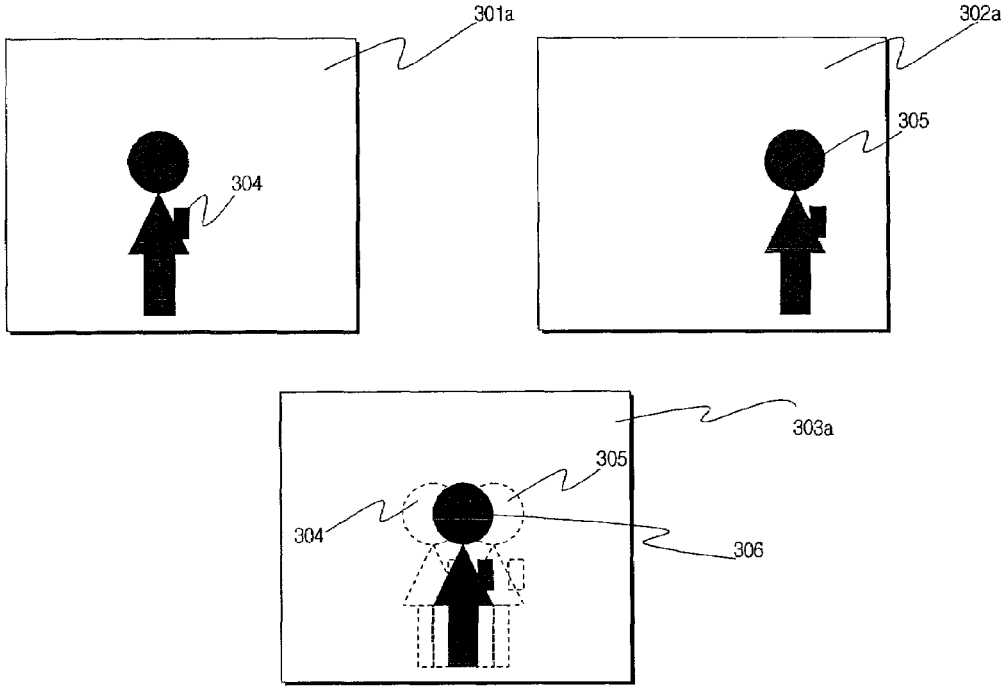
FIG. 12 shows a process of generating an object of an insertion frame.

FIG. 11 shows a process of dividing frame data into a main object and a background image, and FIG. 12 shows a process of generating an object of an insertion frame. Referring to FIGS. 11 and 12, an input frame 301 is divided into a main object image 301*a* and a background image 301*b*. The (N−1) th object image 301*a* and the Nth object image 302*a* respectively separated from the (N−1)th frame and the Nth frame are combined to generate an object image 303*a* of the insertion frame. A background image 301*b* of the insertion frame is generated by averaging background image data of the (N−1) th frame and background image data of the Nth frame.

Figure 13:
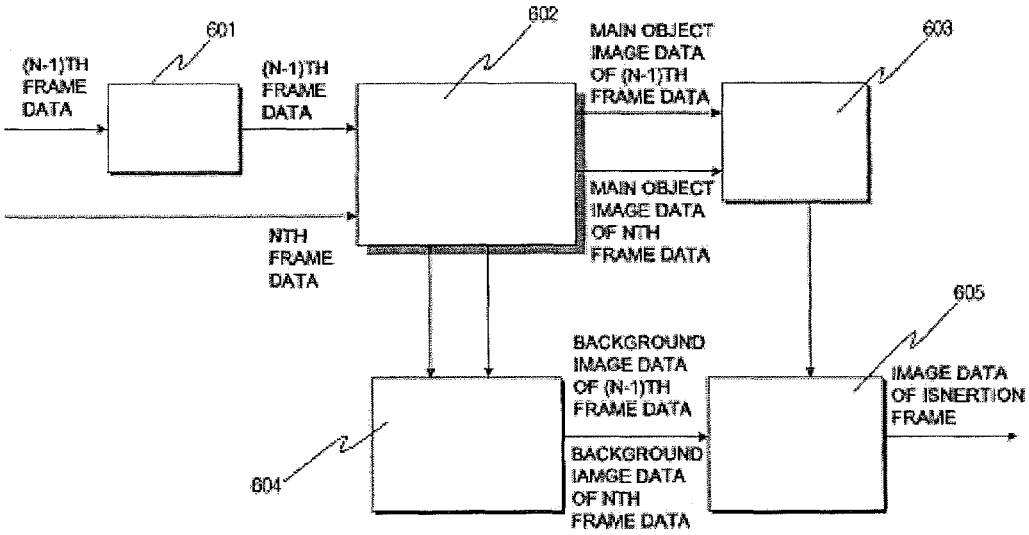
FIG. 13 is a block diagram showing a driving method for removing large area flicker of a PDP.
Figure 14:
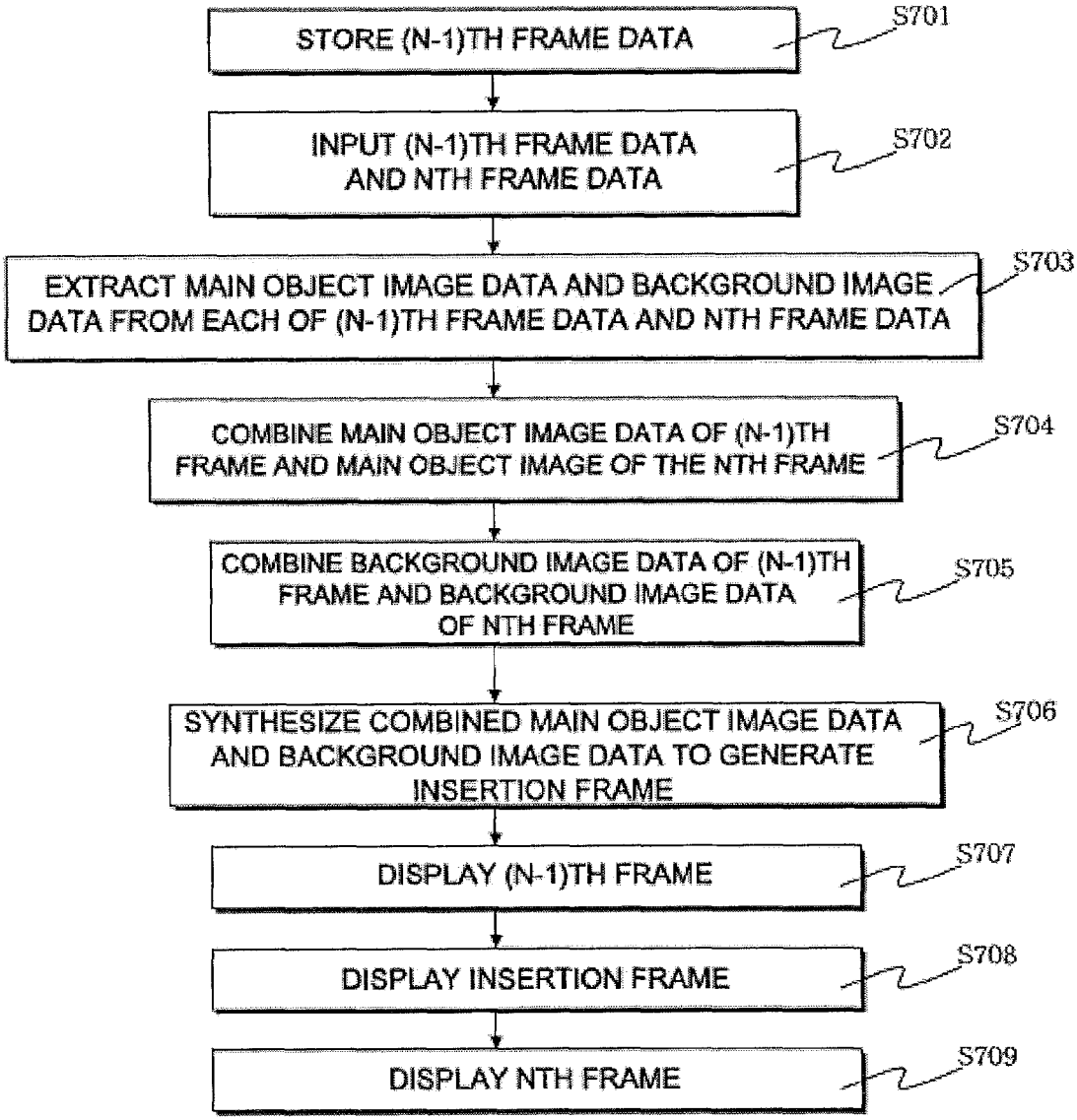
FIG. 14 is a flow chart showing the driving method for removing large area flicker of a PDP.

FIG. 13 is a block diagram showing a driving method for removing large area flicker of a PDP, and FIG. 14 is a flow chart showing the driving method for removing large area flicker of a PDP. The process of generating the insertion frame will now be explained with reference to FIGS. 13 and 14.

The input (N−1)th frame data is stored in a frame memory 601 in the step S701.

The (N−1)th frame data and the Nth frame data are input, and main object image data of the (N−1)th frame data and main object image data of the Nth frame data are detected in the step S702. The detected main object image data and background image data are extracted in the step S703. As a method of detecting the main object image data, the conventional gradient watershed algorithm or region growing image processing algorithm is preferably used. When the object image is detected and extracted from each frame using the algorithm, the main object image data and background image data are separated from each of the (N−1)th frame data and the Nth frame data.

Then, a main object image of the insertion frame is generated in the step S704. The main object image data of the (N−1)th frame and the main object image data of the Nth frame, separated in the step S703, are combined by the following method.

The main object image data of the Nth frame is compared with the main object image data of the (N−1)th frame. A common value among the main object image data values of the two frames is used as it is for constructing the main object image of the insertion frame. Among the main object image data values of the two frames, a difference value between main object image data values of the two frames is not used. Instead an intermediate value of the corresponding main object image data values of the two frames is used for constructing the main object image of the insertion frame.

The reconstructed data generates the main object image of the insertion frame as shown in FIG. 12.

In the step S705, the background image of the insertion frame is generated. A method of generating the background image of the insertion frame is different from the method of generating the main object image of the insertion frame in the step S704. That is, the background image data of the insertion frame is generated using the background image data of the (N−1)th frame and the background image data of the Nth frame. Since there is a little difference between the background image data of the (N−1)th frame and the background image data of the Nth frame, a value obtained by adding up the two background image data values and dividing the added value by half can be used or a blurred image obtained by simply adding up the two background image data items can be used.

In the step S706, the insertion frame is generated by synthesizing the main object image data of the insertion frame, generated in the step S704, and the background image data of the insertion frame, generated in the step S705. That is, the object image and background image of the insertion frame are synthesized to accomplish one insertion frame image.

In the steps S707, S708 and S709 for displaying frames, the generated insertion frame is inserted between the (N−1)th frame and the Nth frame.

For up-converting a frame frequency to 75 Hz, the number N can be selected from odd numbers. That is, the first and second frames generate one insertion frame and the third and fourth frames generate one insertion frame. This is repeated until the forty-ninth and fiftieth frames generate one insertion frame. In this manner, twenty-five insertion frames are generated. Accordingly, the total number of frames can be 75.

The number N is not limited to odd numbers and it can be an even number.

The 75 Hz up-conversion is an example and any up-conversion can be achieved. That is, it is possible to generate insertion frames based on a desired number of frames.

In general, when a PDP is driven in W-VGA, twenty-four sub fields are used for two frames because twelve sub fields are used for one frame. When these two frames are divided into three frames, the PDP can be driven using SW8-SW8-SW8/SW8-SW7-SW9/SW9-SW6-SW9 method or SWSE-combined 8-8-8/8-7-9/9-6-9 method.

For example, when the PDP is driven in 8-8-8 SF structure, the insertion frame is generated using the method provided by the present invention and then an image is represented with eight sub fields.

As described above, the present invention can remove large area flicker generated when a 50 Hz video signal such as PAL or SECAM is input in a PDP or a digital micro-mirror device panel. Furthermore, the present invention can be applied to light-emitting devices such as a digital micro-mirror device in addition to the PDP.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving a plasma display panel comprising the steps of: writing nth frame data (n is a natural number) in an odd-numbered line of a memory, writing (n+1)th frame data in an even-numbered line of the memory, generating a single insertion data item using data items read by addressing the odd-numbered line and even-numbered line of the memory, and inserting the insertion data between the nth frame data and the (n+1)th frame data; and providing the nth frame data, the (n+1)th frame data and the insertion data to the plasma display panel.

2. The method as claimed in claim 1, wherein the nth frame data and the (n+1)th frame data are input at a frame frequency of 50 Hz.

3. The method as claimed in claim 2, wherein the insertion data is inserted between two frame data items adjacent to each other among five frame data items input at the frame frequency of 50 Hz.

4. The method as claimed in claim 1, wherein the insertion data corresponds to a mean value of the odd-numbered line data and even-numbered line data of the memory.

5. The method as claimed in claim 1, wherein the insertion data is a copy of one of the odd-numbered line data and even-numbered line data of the memory.

6. An apparatus for driving a plasma display panel comprising: a memory including an odd-numbered line storing nth frame data (n is a natural number) and an even-numbered line storing (n+1)th frame data; a signal processor for generating a single insertion data item using data items read by addressing the odd-numbered line and even-numbered line of the memory and inserting the insertion data between the nth frame data and the (n+1)th frame data; and a data providing unit for providing the nth frame data, the (n+1)th frame data and the insertion data to the plasma display panel.

7. The apparatus as claimed in claim 6, wherein the nth frame data and the (n+1)th frame data are input at a frame frequency of 50 Hz.

8. The apparatus as claimed in claim 6, wherein the signal processor calculates a mean value of the odd-numbered line data and even-numbered line data of the memory to generate the insertion data.

9. The apparatus as claimed in claim 6, wherein the signal processor copies one of the odd-numbered line data and even-numbered line data of the memory to generate the insertion data.

10. The apparatus as claimed in claim 6, wherein the signal processor inserts the insertion data between two frame data items adjacent to each other among five frame data items input at the frame frequency of 50 Hz.

11. A method for driving a plasma display panel, comprising the steps of: storing (N−1)th frame data in a frame memory; separating main object image data and background image data from each of the stored (N−1)th frame data and Nth frame data currently input; generating object image data of an insertion frame using the main object image data of the (N−1)th frame data and the main object image data of the Nth frame data; generating background image data of the insertion frame using the background image data of the (N−1)th frame data and the background image data of the Nth frame data; and synthesizing the main object image data and background image data of the insertion frame to generate the insertion frame.

12. The method as claimed in claim 11, further comprising a step of displaying the (N−1)th frame, a step of displaying the insertion frame, and a step of displaying the Nth frame.

13. The method as claimed in claim 11, wherein N is a number selected from 1 through 50.

14. The method as claimed in claim 11, wherein the frames are driven at a frequency of 75 Hz.

* * * * *